US011434125B2

(12) United States Patent
Harr

(10) Patent No.: US 11,434,125 B2
(45) Date of Patent: Sep. 6, 2022

(54) AUTOMATED BEVERAGE POURING DEVICE WITH FOAM CONTROL

(71) Applicant: WhidBrew Technologies, Inc, Langley, WA (US)

(72) Inventor: William Harr, Langley, WA (US)

(73) Assignee: WHIDBREW TECHNOLOGIES, INC, Langley, WA (US)

( * ) Notice: Subject to any disclaimer, the term of this patent is extended or adjusted under 35 U.S.C. 154(b) by 0 days.

(21) Appl. No.: 17/159,107

(22) Filed: Jan. 26, 2021

(65) Prior Publication Data

US 2021/0380395 A1 Dec. 9, 2021

Related U.S. Application Data

(60) Provisional application No. 63/034,983, filed on Jun. 5, 2020.

(51) Int. Cl.
*B67D 1/14* (2006.01)
*B67D 1/08* (2006.01)

(52) U.S. Cl.
CPC ..... *B67D 1/1427* (2013.01); *B67D 1/0888* (2013.01); *B67D 1/0894* (2013.01)

(58) Field of Classification Search
CPC ... B67D 1/1427; B67D 1/0888; B67D 1/0894
USPC ..... 141/272, 274–276
See application file for complete search history.

(56) References Cited

U.S. PATENT DOCUMENTS 2,757,846 A * 8/1956 Varrin ..... G01F 23/205 222/440
4,456,040 A * 6/1984 Bacroix ..... B67C 3/02 141/172
4,784,193 A * 11/1988 Schmied ..... B67D 1/0855 141/198
4,974,643 A * 12/1990 Bennett ..... B67D 1/124 141/86
5,086,817 A * 2/1992 Murphy ..... B67D 1/0894 141/369
5,115,841 A * 5/1992 Horino ..... B67D 1/1411 141/46
5,335,705 A * 8/1994 Morishita ..... B67D 1/04 222/61
5,791,385 A * 8/1998 Stahlecker ..... B67C 3/24 141/270

(Continued)

*Primary Examiner* — Timothy L Maust
(74) *Attorney, Agent, or Firm* — FisherBroyles, LLP; Jeremy P. Sanders

(57) ABSTRACT

A beverage pouring device includes a cradle that is moveable between a first position and a second position under a dispensing spigot. The cradle supports a glass and moving the cradle to the second position actuates a valve to dispense beverage into the glass. After partially filling the glass, the cradle automatically returns to the first position and the device continues filling the glass to a desired volume. The device starts and stops the flow of beverage automatically to arrive at a desired volume within the glass. The automatically moving cradle helps with foam control while allowing the glass to be filled hands-free which allows the user to do other tasks while the glass is being filled. The device tracks beverage statistics and sends these statistics to a remote computing device, as well as provides an alert when the beverage source approaches emptiness.

13 Claims, 9 Drawing Sheets

(56) References Cited

U.S. PATENT DOCUMENTS

| | | | | |
|---|---|---|---|---|
| 5,921,293 | A * | 7/1999 | Berger | B65B 3/22 141/276 |
| 7,311,125 | B2 * | 12/2007 | Krulitsch | B67C 3/242 141/148 |
| 7,748,417 | B2 * | 7/2010 | Arcuri | B67D 1/127 141/192 |
| 8,505,594 | B2 * | 8/2013 | Krulitsch | B67C 3/004 141/90 |
| 9,376,304 | B2 * | 6/2016 | Trulaske | B67D 1/1272 |
| 11,046,572 | B2 * | 6/2021 | Edwards | B67D 1/0894 |
| 2008/0142115 | A1 * | 6/2008 | Vogt | B67D 1/124 141/374 |
| 2019/0144255 | A1 * | 5/2019 | Dresser | B67D 1/0881 141/94 |

* cited by examiner

AUTOMATED BEVERAGE POURING DEVICE WITH FOAM CONTROL

CROSS REFERENCE TO RELATED APPLICATIONS

This application claims the benefit under 35 U.S.C. § 119(e) of U.S. Provisional Application No. 63/034,983, filed Jun. 5, 2020, the disclosure of which is incorporated, in its entirety, by this reference.

BACKGROUND

In many beer-pouring establishments, a bar tender will hold a glass underneath a beer spigot, pull a tap handle, and dispense product into the glass. In some cases, the bar tender will tilt the glass away from vertical so that the initially dispensed beer will contact the side of the glass and run down toward the bottom. This is primarily done for foam control as dispensing the beer directly toward the bottom of the glass causes more of the carbon dioxide within the beverage to coalesce into bubbles and rise to the surface, creating a head. In many cases, the bar tender will also slowly pour the beer into the glass to inhibit foam from forming on the surface of the beverage.

The dispensing of beer from a tap is a learned process and requires practice in order to get the right amount of head on the beer, which is desirable for releasing flavors and some of the carbon dioxide within the beverage.

The proper dispensing of beer into a glass can cause the bar tender to spend upwards of 20, 30, 40 seconds or more per glass in order to serve customers. In a busy establishment, this can cause significant delays and limits the bar tenders' ability to serve customers in a timely fashion. Furthermore, because beer dispensing is a manual process, it can be difficult to dispense a repeatable volume of product which results in either overpours or underpours which are both undesirable.

It would be a significant advantage for a system to be able to accurately and repeatedly dispense beverages, such as beer, while providing foam control to provide a desirable amount of head. It would be a further advantage if such a system did not constrain the bar tender to manually oversee the dispensing process. Finally, a system that additionally tracked beverage dispensing would provide additional benefits.

SUMMARY

According to some embodiments, an automated beverage tipping tap system functions to properly pour a beverage, such as beer, in a preferred pouring operation that provides a desirable amount of head. The head (e.g., foam) of a beer is a result of nucleation that causes carbon dioxide within the beverage to coalesce into bubbles and be released from the beverage. The head also provides an olfactory sensation as well as allows a consumer to experience the subtleties of the beverage by tasting the sweetness of the malt and the bitterness of the hops. In some embodiments, the system will tip the glass (or hold the glass) at a desired angle and pour a first volume of beverage into the glass. The system may then tip the glass at a second desired angle, which may be approximately upright, and pour a second volume of beverage into the glass. The system may control the first volume and second volume to provide an accurate dispensed volume. Moreover, the system may track the dispensed volume over time and provide one or more alerts when the dispensed volume reaches a threshold value. The alert may be provided locally to the dispensing system, may be provided remotely, such as to a computer device, or a combination of alerts.

According to some embodiments, a beer pouring device, includes one or more processors; memory in communication with the one or more processors, the memory storing instructions that, when executed by the one or more processors, cause the one or more processors to perform acts; a mount configured to mount the device to a beer tap; a cradle pivotally coupled to the mount, the cradle configured to hold a glass and to be moved between a first position and a second position; a latch for securing the cradle in the second position; a switch located on the mount and configured to be actuated by the cradle in the second position; an electrically actuatable fluid valve; a flow sensor along a fluid flow path to determine a volumetric flow of beer along the fluid flow path; and a wireless communication system configured to send beverage data to a remote computing device.

The beer pouring device may further include a control system such as one or more user actuatable buttons to control the electrically actuatable fluid valve. For example, one or more buttons may allow a user to interrupt the dispensing of the beer, open the valve to dispense additional beer, or indicate that the keg has been changes, among other things.

In some examples, the cradle is configured to move from the second position to the first position via gravity, and a damper may be provided in the mount to slow a movement of the cradle from the second position to the first position. The damper may be a rotary damper to soften the travel of the cradle to inhibit beer from spilling outside the glass.

In some cases, the instructions stored on the memory cause the one or more processors to determine that the cradle is in the second position and actuate the electrically actuatable fluid valve to dispense beer. For example, moving the cradle to the second position may depress a switch, which may send a signal that results in opening of the valve to dispense beer.

In some embodiments, the instructions cause the one or more processors to release the cradle from the second position, such as by actuating the latch to release the cradle; determine a total volume of beer dispensed; and actuate, in response to determining that the total volume of beer dispensed has reached a threshold value, the electrically actuatable fluid valve to stop dispensing beer.

In some cases, the second position allows a glass supported by the cradle to be oriented at an angle with respect to a spigot to cause dispensed beer to contact a side of the glass. This ensures that dispensed beer contacts the side of the glass and runs to the bottom of the glass to control the foam of the beer. In some cases, the cradle moves to the first position and beer is dispensed into the glass without contacting the side of the glass to create a desirable head on the beer.

In some instances, a feedback system is provided and configured to alert a user when a keg of beer in fluid communication with the beer pouring device is nearly empty. The feedback system may comprise a light on the device, an audible alert, a text message sent to a computing device associated with a user, a message displayed on a display, or some other form of notification.

In some cases, the beverage data includes one or more of a time and/or date of a pour, an elapsed time associated with the pour, an identification of the beer, a total volume of beer dispensed, and the volume of beer remaining in a keg.

According to some embodiments, a method of dispensing a beverage from a beverage dispensing system having a cradle moveable between a first position and a second position, a fluid valve, and a flow sensor, includes determining that the cradle has moved from the first position to the second position; actuating the fluid valve to dispense the beverage; determining, by the flow sensor, that a volumetric flow of dispensed beverage has reached a first volume threshold; releasing the cradle from the second position and allowing the cradle to return to the first position; determining, by the flow sensor, that the volumetric flow of dispensed beverage has reached a second volume threshold; and actuating the fluid valve to stop dispensing the beverage.

The method may further include the step of determining beverage data associated with the dispensing of the beverage and storing the beverage data. In some cases, the beverage data may be sent to a remote computing resource. The beverage data may include one or more of an identifier associated with the beverage, a date and/or time of day that the beverage is dispensed, a first elapsed time to reach the first volume threshold, a second elapsed time to reach the second volume threshold, a total volume dispensed, a remaining volume in a beverage storage container, a temperature of the beverage, a number of times the beverage is dispensed, and an indication when a beverage storage container in fluid communication with the beverage dispensing system is replaced.

The method may further include the step of closing the valve, for a delay time, while the cradle at least partially moves from the second position to the first position.

In some instances, the method includes the step of actuating the valve, after the delay time, to continue dispensing beverage.

According to some embodiments, a beverage dispenser includes a processor; a fluid valve; and a cradle moveable between a first position and a second position.

The beverage dispenser may have a latch configured to hold the cradle in the second position. In some cases, the processor may be configured to issue instructions to release the latch to allow the cradle to move to the first position. The cradle may move by the force of gravity or may have an actuator to move the cradle. In some cases, a damper is provided to slow and control the movement of the cradle from the second position to the first position.

The beverage dispenser may include a wireless communication device configured to send beverage data associated with the beverage dispenser to a remote computing device. The beverage data may include any data associated with the beverage dispenser, the beverage, or a beverage storage container.

DETAILED DESCRIPTION

Figure 1:
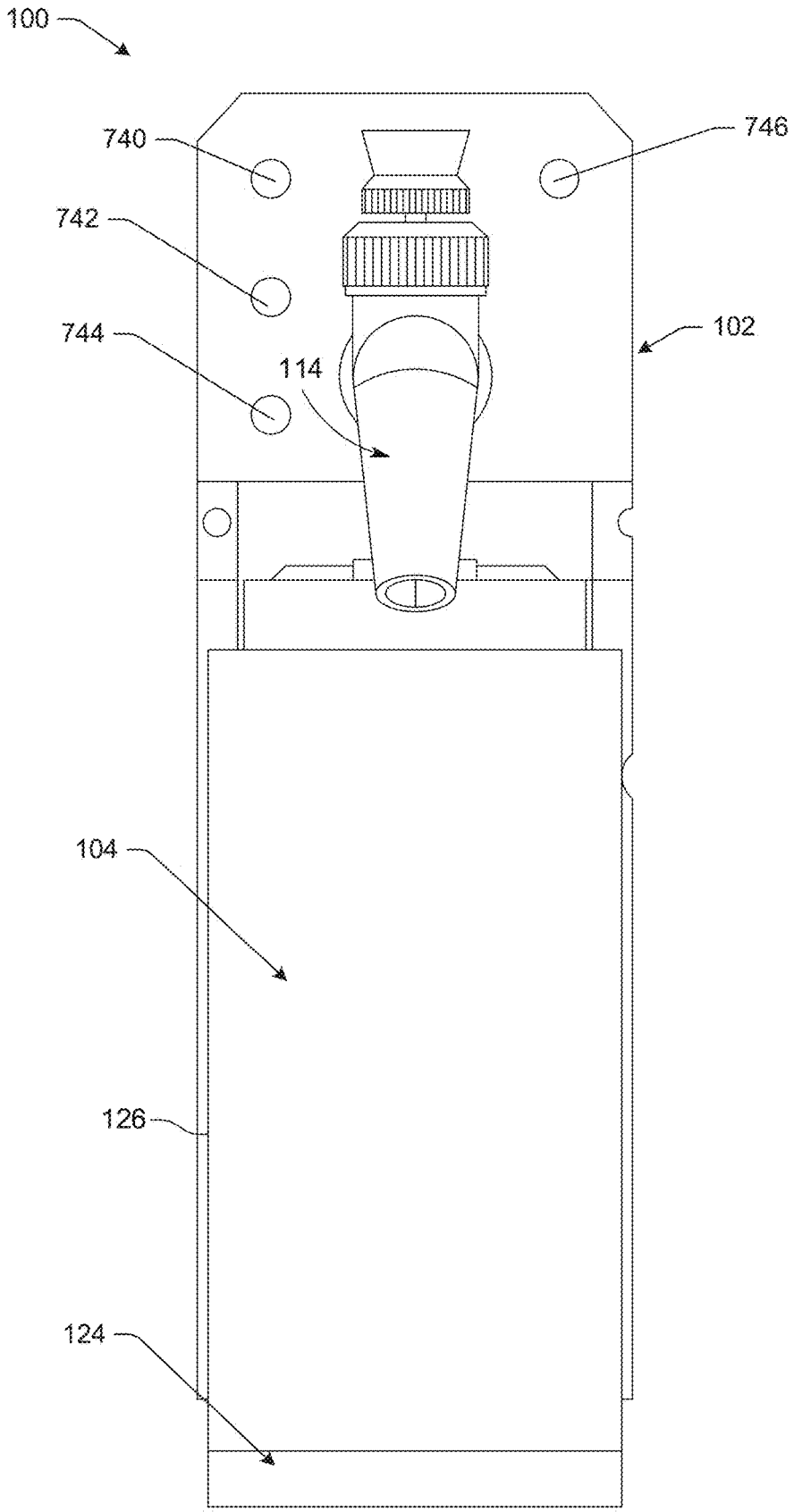
FIG. 1 illustrates a front view of a beverage dispenser, in accordance with some embodiments.
Figure 2:
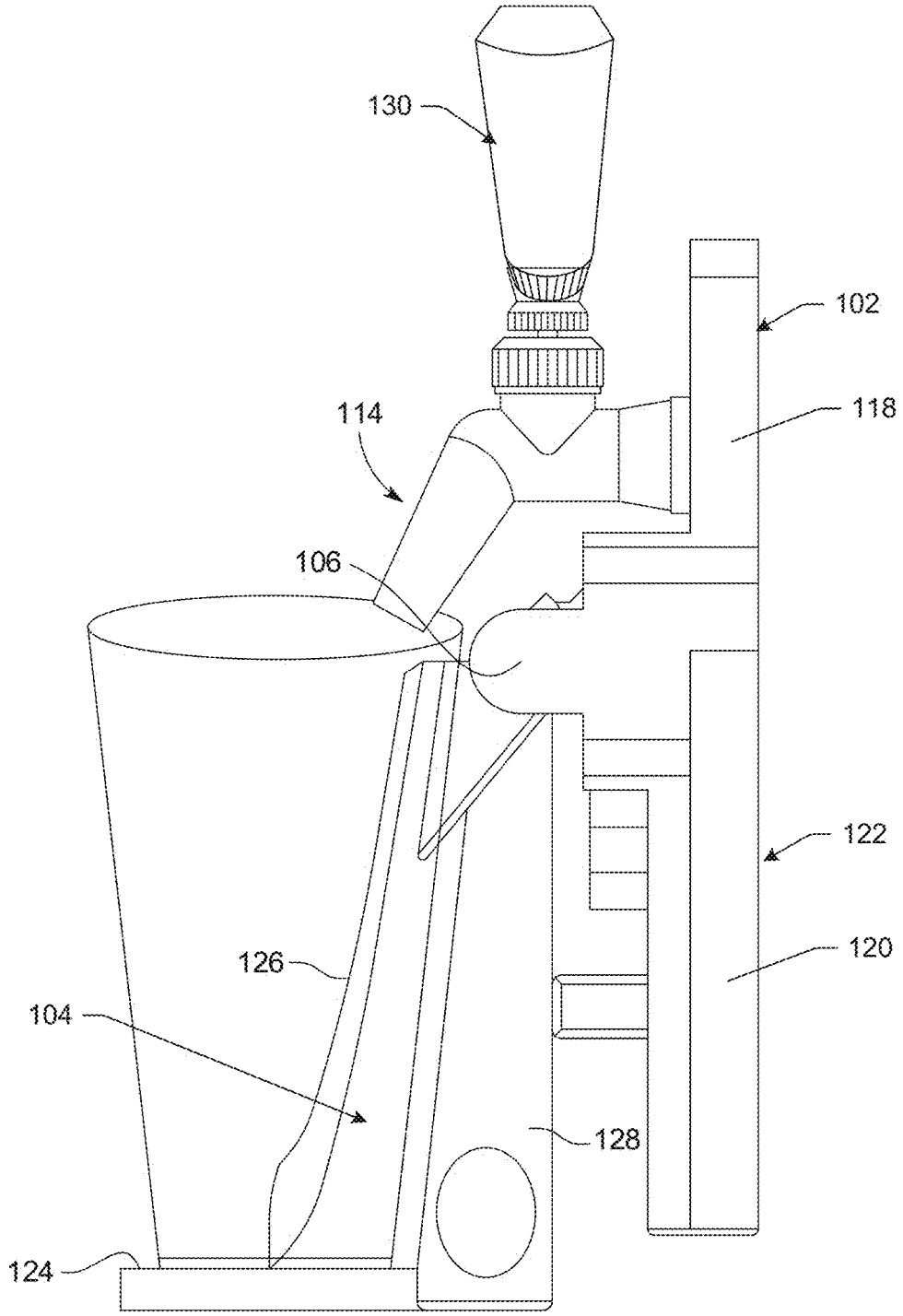
FIG. 2 illustrates a side view of a beverage dispenser where a cradle is in a first position, in accordance with some embodiments.
Figure 3:
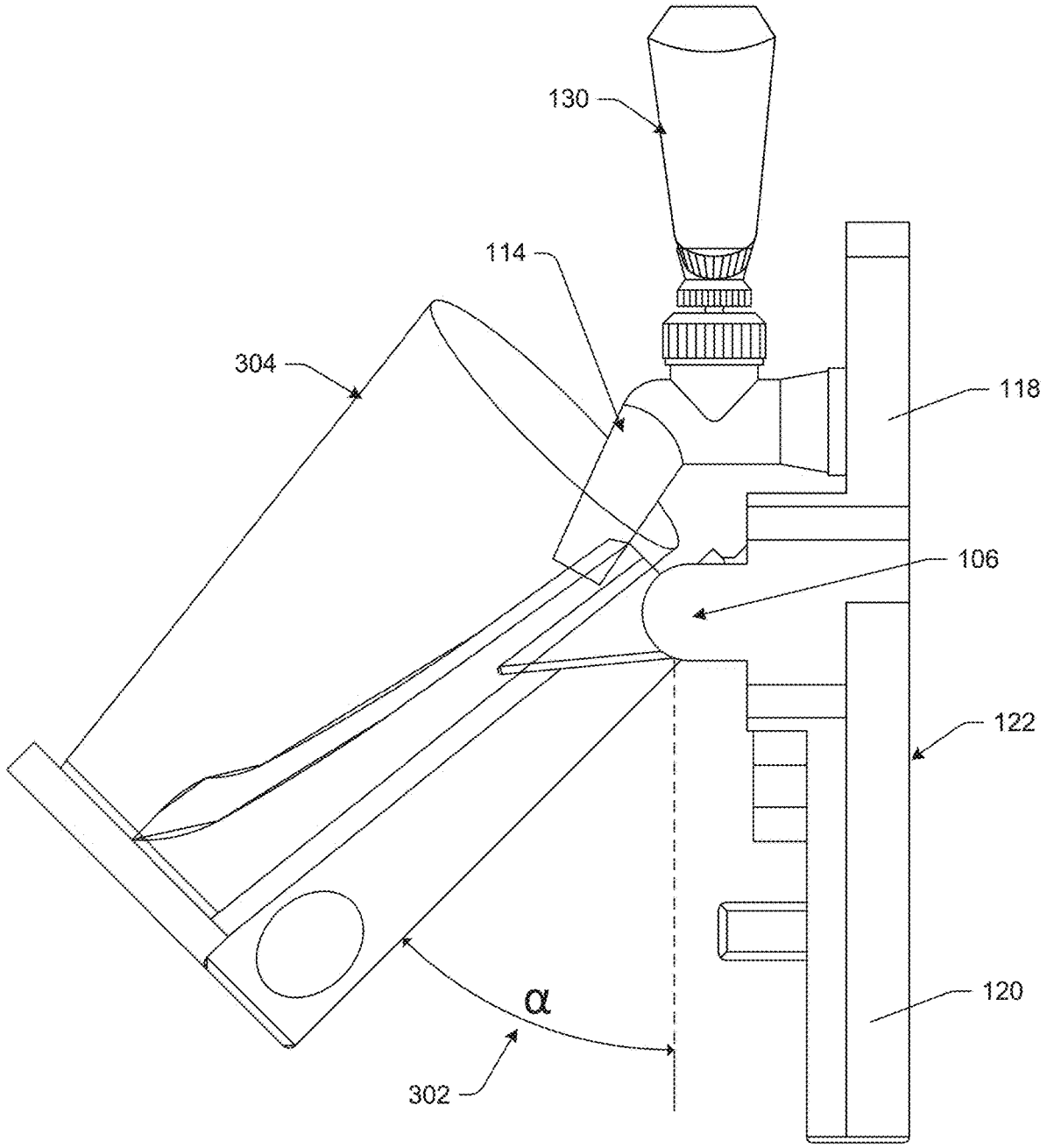
FIG. 3 illustrates a side view of a beverage dispenser where a cradle is in a second position, in accordance with some embodiments.
Figure 4:
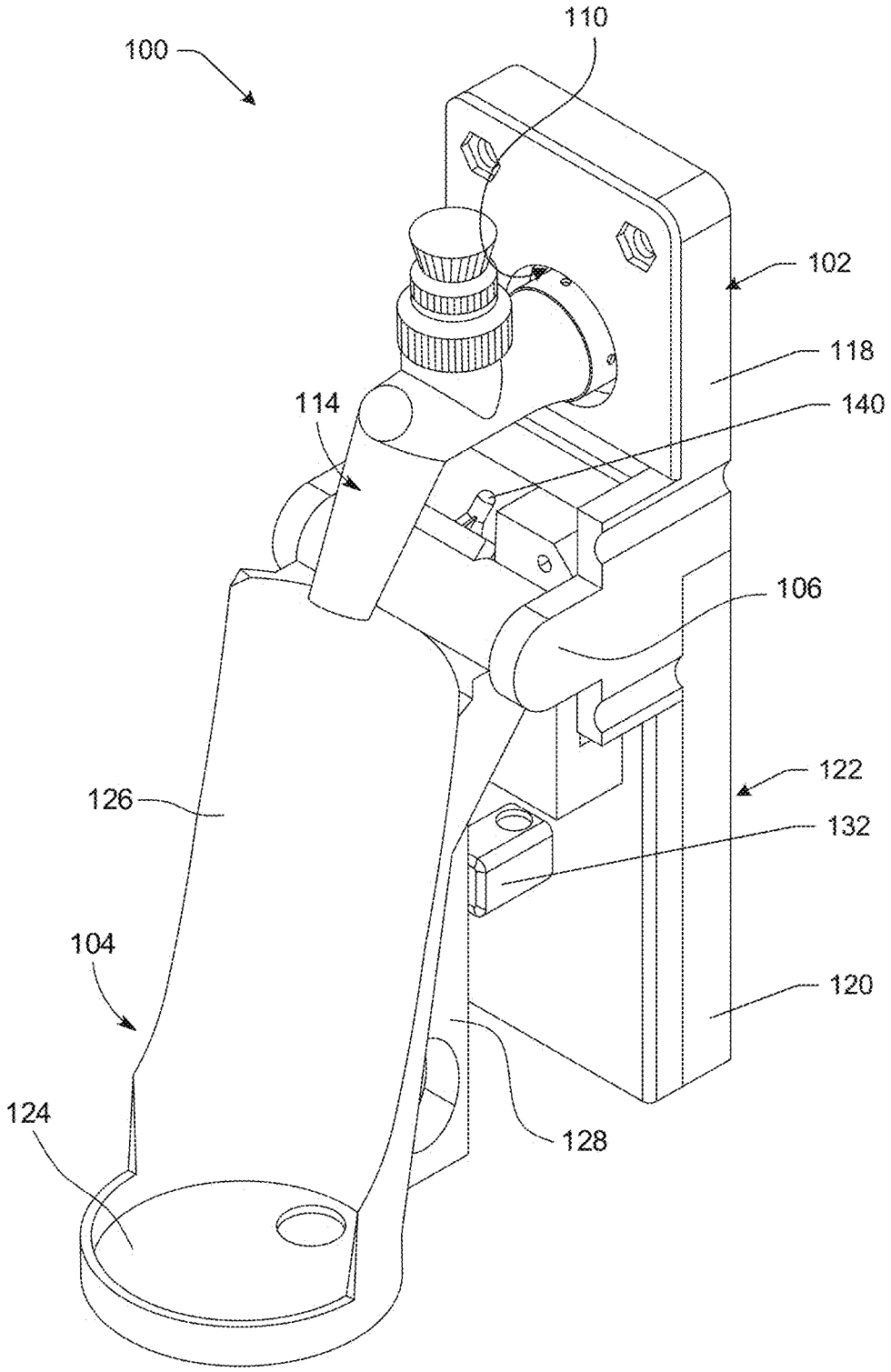
FIG. 4 illustrates a perspective view of a beverage dispenser having a cradle moveable between a first position and a second position, in accordance with some embodiments.
Figure 5:
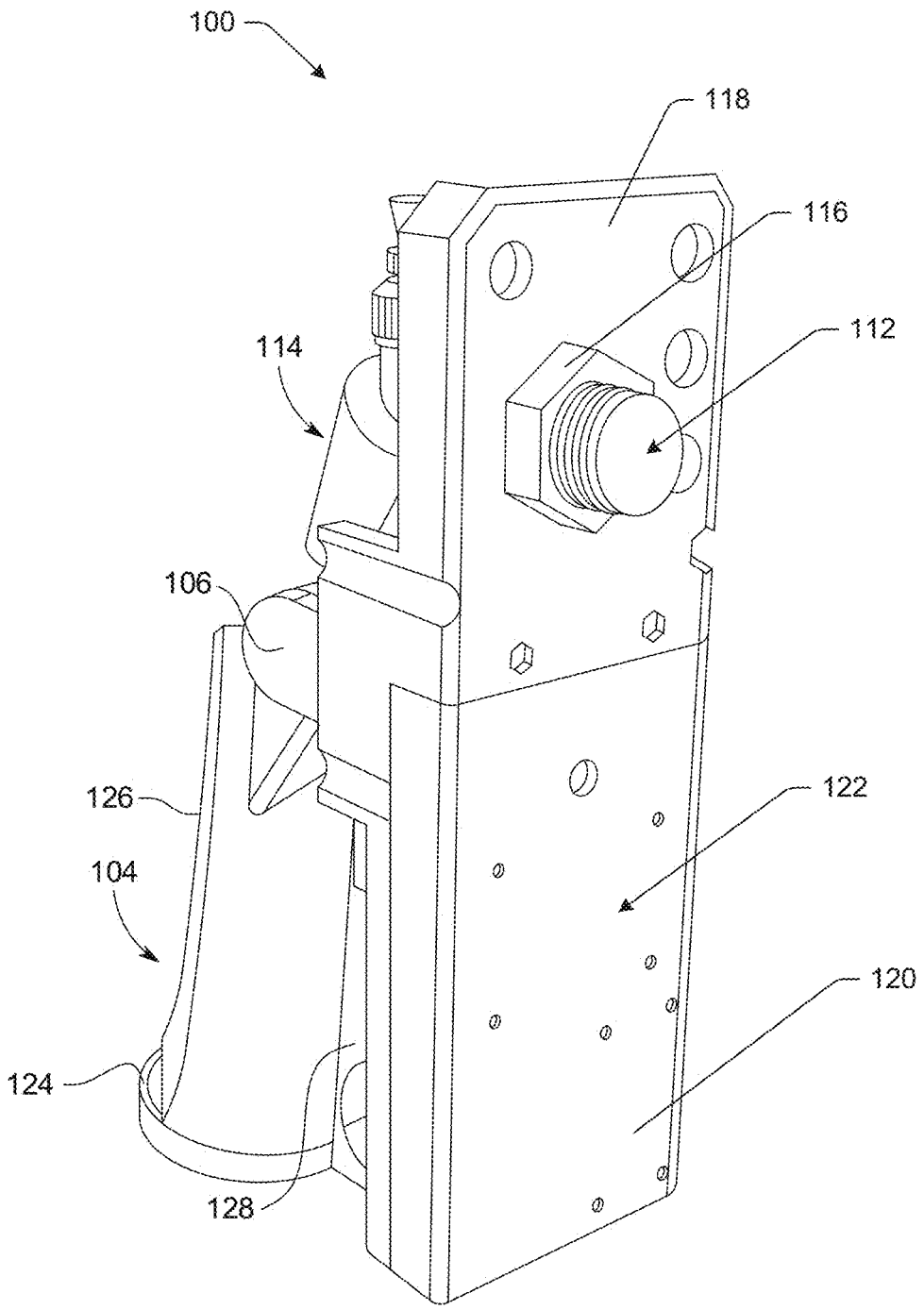
FIG. 5 illustrates a rear perspective view of a beverage dispenser, in accordance with some embodiments.
Figure 6:
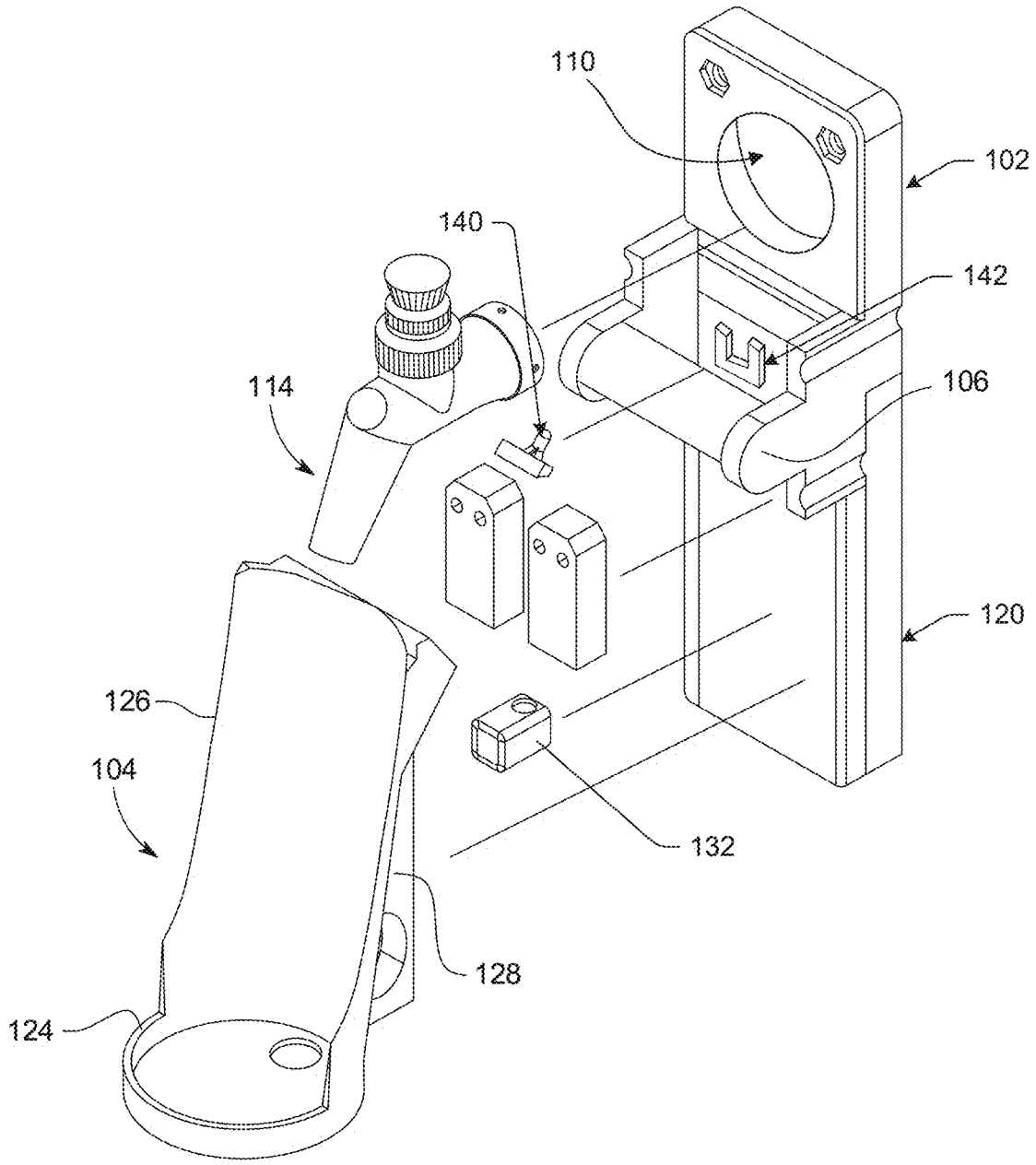
FIG. 6 illustrates an exploded view of components of a beverage dispenser, in accordance with some embodiments.

This disclosure generally relates to a system for accurately pouring a beverage into a container. In some examples, the beverage is beer but of course, other beverages could be poured using the systems and methodologies described herein. Similarly, the container in many examples is a glass, but of course, other containers may be used, such as a jug, pail, growler, pitcher, or other suitable liquid container.

With reference to FIGS. 1-6, according to some embodiments, a tipping tap 100 includes a mount 102, a cradle 104, and a pivot 106. The mount 102 includes a spigot aperture 110 through which a shank 112 of a spigot 114 passes. In some cases, a retainer 116 is affixed to the portion of the shank 112 passing through the spigot aperture 110 and secures the spigot 114 to the mount 102.

The mount 102 includes an upper portion 118 to which the spigot 114 mounts and a lower portion 120. In some cases, the lower portion 118 includes a cavity defined within the lower portion 120, which may be a housing 122 to contain one or more components of the tipping tap 100. For example, the cavity may be a housing to secure components such as one or more of a battery, a microprocessor, a memory, a communications system, electrical leads extending to one or more microswitches, sensors, solenoids, a wireless communication interface, and a power unit, among other components which will be described in later detail herein. The cavity may be selectively opened, such as by providing a cover to provide access to the components within the housing 120.

While the systems and components described herein may be utilized in any liquid pouring scenario, for convenience of description, many of the embodiments shown and described are in the context of a beer dispensing system, which may include a beer tap. In some cases, a beer tap includes a spigot 114, a tap handle 130, and a valve within the spigot 114 that is actuatable by the tap handle 130. The spigot 114 may be in fluid communication with a beer keg, which may be pressurized to deliver pressurized beverage to the beer tap. In typical cases, as the tap handle 130 is pulled forward, the valve within the spigot opens and the beer is allowed to flow out of the spigot 114 into a container.

According to some embodiments, the cradle 104 includes a bottom support 124, which may be configured to support a container, such as a glass, and further includes a side support 126 that is configured to support a glass, such as when the cradle 104 is tipped. In some cases, where the cradle 104 is tipped, the side support 126 inhibits the container from sliding off the bottom support 124. The cradle 104 may further include a stiffener 128 which may improve the rigidity of the side support 126.

The mount 102 may carry a pivot 106 that allows the cradle 104 to be positioned between a first position (see FIG. 2) in which the bottom support 124 is generally horizontal such as for supporting a container in a generally upright orientation, and a second position (see FIG. 3) in which the cradle 104 is rotated about the pivot 406 such that the bottom support 124 is inclined at an angle relative to horizontal. In the second position (FIG. 3), a container may be supported by both the bottom support 124 and the side support 126 to maintain the container secured within the cradle 104. In some cases, the angle α is about 30° relative to horizontal, or about 35°, or about 40°, or about 45°, or about 50°, or some other suitable angle for holding the container relative to the spigot to allow dispensed beverage to first contact the side of the container and thereafter flow toward the bottom of the container as the container is filled with the dispensed beverage.

The pivot 106 includes structure that allows the cradle 104 to be repositioned between a first position and a second position, as described. In some cases, the cradle is moved from the first position to the second position by manual input, such as by an operator manually moving the cradle 104 from the first position to the second position.

In some cases, the cradle 104 includes a shaft that is journaled by the pivot 106 at one or both ends of the shaft. The shaft provides a hinge line about which the cradle 104 can be rotated. The pivot may include one or more bearings to allow the pivot 106 to function smoothly and with reduced friction as compared to a pivot without one or more bearings.

In some embodiments, the pivot may include a damper, which is some cases is a rotary damper and may be disposed internal to the pivot 106. The rotary damper may be any suitable damper and may include one or more of springs, fluid, friction bearing surfaces, or a combination. In some cases, the damper is filled with a viscous fluid which passes through rotating vanes to allow the cradle 104 to move by the force of gravity in a smooth and controlled motion from the second position to the first position. In some cases during use, as the container is in the second position, the container will be at least partially filled with a beverage and the cradle 104 moves from the second position to the first position while the container is filled, or partially filled, with beverage. The rotary damper promotes the cradle and partially filled container making a smooth and controlled transition from the second position to the first position, as will be described in further detail hereinafter.

In many cases, embodiments shown and described herein can be fit, or retrofit, onto existing taps. For example, a tap can be disassembled by removing the spigot 114 and tap handle 130 from a tap, feeding the shank 112 of the spigot 114 through the spigot aperture 110, and securing the spigot 114 to the upper portion 118, such as by a retainer (e.g., nut). In some cases, a spacer is provided over the shank 112 of the spigot 114 to provide a space between the device 100 and the keg, tap tower, wall of the brew house, or some other structure to which the spigot is typically mounted.

The lower portion 120 includes a stop 132 that provides a travel limit to the cradle 104. The stop may be a boss or protrusion formed integrally with, or attached to, the lower portion 120. As the cradle moves from the second position to the first position, the stop 132 provides a surface against which the stiffener 128, or another part of the cradle 104, contacts to limit movement and provide support to the cradle 104 when in the first position.

In some embodiments, a latch is provided to maintain the cradle 104 in the second position. In some examples, the latch includes a latch pin 140 and a keeper 142 that may receive the latch pin 140 and inhibit the latch pin 140 from releasing from the keeper 142 until an appropriate time. In some cases a switch is incorporated into the upper portion 118, and may be incorporated adjacent to, or within, the latch keeper. In some examples, when the latch pin 140 engages with the keeper 142, the switch is actuated which may control a fluid valve that allows beverage to flow through the spigot. A control signal, to be described hereinafter, may be sent to the keeper 142 to release the latch pin 140 and allow the latch pin 140 to disengage from the keeper 142, such as after a predetermined time period, volumetric flow, or some other parameter.

The tipping tap 100 components may be manufactured of any suitable material and through any suitable process. For example, any additive manufacturing process, any subtractive manufacturing process, or any molding process, or a combination of processes may be used to make one or more of the parts that may be assembled into a tipping tap 100. In some cases, one or more of the parts that come in contact with a beverage are formed of suitable materials that promote proper sanitation, and in some cases, may be formed of stainless steel, polyvinyl chloride, any of a number of suitable plastics, or combinations of materials.

Suitable processes for forming the components of the tipping tap 100 include 3D printing, molding, machining, stamping, and the like. In some embodiments, one or more of the components may be made of a suitable plastic and may be formed through additive manufacturing techniques (e.g., 3D printing), by injection molding, or any suitable process or combination of processes.

Figure 7:
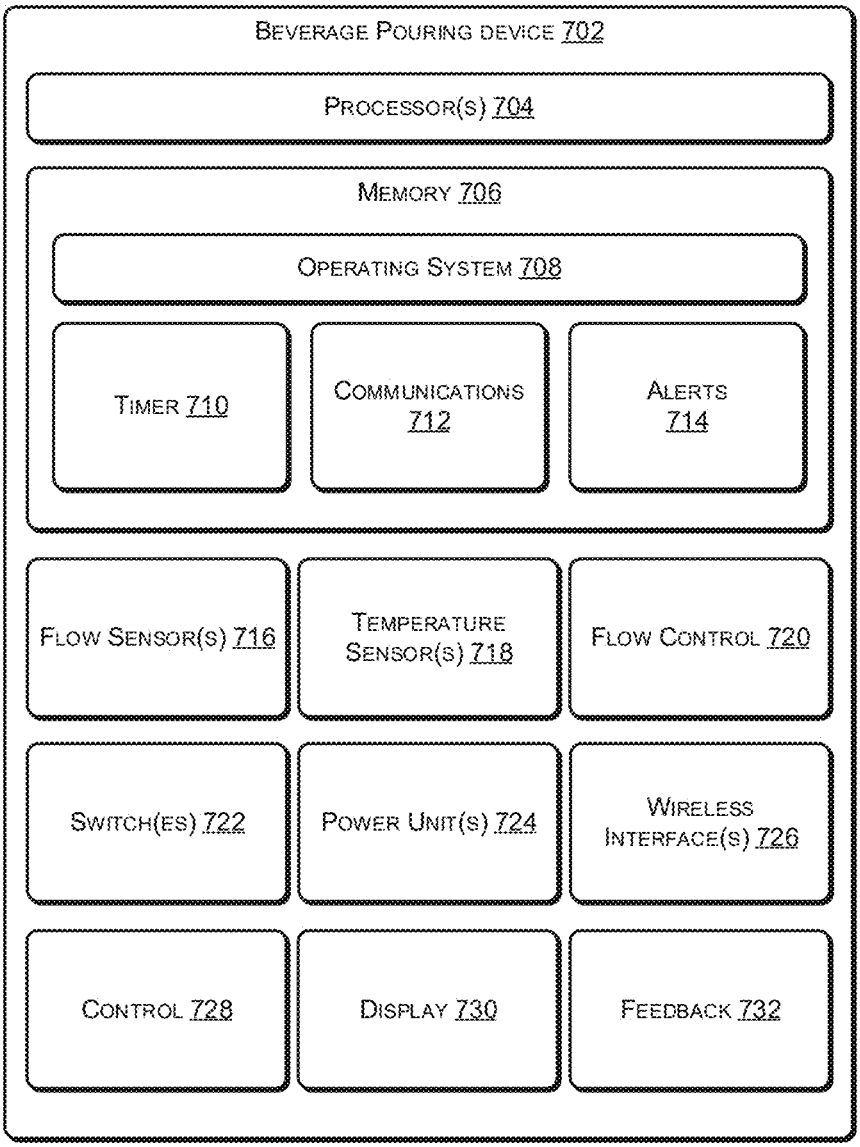
FIG. 7 illustrates a block diagram showing some of the components associated with a beverage dispenser; in accordance with some embodiments.

With reference to FIG. 7, in some embodiments, the tipping tap 100, also referred to as a beverage pouring device 702, includes one or more processors 704 that are in communication with a computer readable storage media, (e.g., memory device 706) that stores instructions that cause the processor to perform actions.

According to some example embodiments, the systems and/or methods described herein may be under the control of one or more processors 704. The one or more processors 704 may have access to computer-readable storage media ("CRSM"), which may be any available physical media accessible by the processor(s) to execute instruction stored on the CRSM. In one basic implementation, CRSM may include random access memory ("RAM") and Flash memory. In other implementations, CRSM may include, but is not limited to, read-only memory ("ROM"), electrically erasable programmable read-only memory ("EEPROM"), or any other medium which can be used to store the desired information and which can be accessed by the processor(s).

The memory may store an operating system 708 and the operating system 708 may include instructions, modules, routines, or other such code that allow the one or more processors 704 to perform acts. The memory may include modules such as a timer 710, a communications module 712, and instructions that provide for one or more alerts 714 depending on detected conditions, parameters, or thresholds being approached or exceeded.

The beverage pouring device 701 may further include one or more of one or more flow sensors 716, one or more temperature sensors 718, a flow control device 702, one or more switches 722, a power unit 724, wireless interface(s) 726, a control 728, a display 730, and a feedback system 732. Of course, various exemplary beverage pouring devices 701 may include fewer or more components than those listed and shown.

The hardware will be described first, and then followed up by a description of the software code that allows the one or more processors 704 to interact with the items of hardware. One or more flow sensors 716 may be provided and placed within the fluid flow path of the beverage and be configured to determine a volumetric flow of a beverage. For example, in many cases, a beverage, such as beer, is provided in a pressurized container such that when a flow valve is opened, the pressurization causes the beer to flow through a fluid line and out the spigot. The combination of the pressurized container, fluid line, and spigot may define a fluid flow path through which the beverage flows from storage container to serving container. In some cases, the flow sensor 716 is placed within the fluid flow path of the beverage and can be used to measure a volumetric flow rate of the beverage.

A temperature sensor 718 may be provided to ensure that the beverage is being stored and or dispensed at a desirable temperature. Beer drinkers throughout the world often agree that there is a preferable temperature range at which they prefer to enjoy beer. While the beverage storage container may typically be kept chilled, in some cases, an additional temperature sensor 718 provided as part of the fluid delivery flow path provides an additional verification of the temperature of the dispensed beverage and may be used to provide an alert should the cooling system fail to maintain the beverage at an appropriate temperature.

A flow control 720, such as a valve may be placed in line with the beverage fluid flow path. In some cases, an electrically actuatable valve is provided to allow or inhibit the flow of beverage through the fluid flow path. Examples include a rotary and/or a liner valve actuator. In some cases, a solenoid may be used as a valve actuator to allow or inhibit fluid flow through the fluid flow path.

One or more switches 722 may be provided as part of the beverage pouring device 702. For example, a switch may be integrated with the latch keeper 142, such that when the latch pin 140 engages the latch keeper 142, the latch pin 140 actuates a switch 722 which in turn, sends a signal to the one or more processors 704 to indicate that the latch pin 140 is engaged with the keeper 142, and the processor can actuate the flow control valve 720 to dispense a beverage. In some cases, the processor also receives information and initiates a timer 710 and tracks the time associated with a beverage pour.

Additional switches 722 may further be included for any suitable purpose. For example, a switch may be provided, such as on the mount 102 and may be used to control one or more functions of the device 100, or store data points. More specifically, and with additional reference to FIG. 1, a stop switch 740 may be provided as a stop function such that when the stop switch is depressed, the device 100 stops the flow of beverage. The stop switch 740 may override the processor(s) 704 control of the device and stop a beverage pour even if the processor 704 has not sent an instruction to stop the dispensing of the beverage. A top off switch 742 may be provided, such as on the mount, that allows a user to activate the switch to manually control the dispensing of a beverage. For instance, where the operator desires to add more beverage to a container, the user may depress the top off switch 742, which may be a momentary switch, and add additional fluid to the container. A source replacement switch 744 may be provided to allow a user to signal to the device that a beverage source has been replaced. For example, in the context of beer dispensing, when a keg becomes empty, once a user replaces the keg, the user can depress the source replacement switch 744 to indicate to the device 100 that a keg has been replaced. The processor(s) 704 may store this data point, which can be used to determine when the new keg will become empty through tracking the dispensed volume in comparison to a starting volume within the keg.

The power unit 724 may be any suitable power required by the device 100. For instance, power may be supplied to the processor(s) 704, display 730, wireless interface 726, feedback 732 or other components associated with the device 100. The power unit 724 may utilize any suitable AC or DC power supply, including wall power, battery power, or a combination.

A wireless interface 726 may allow the device 100 the ability to communicate with a remote computing device, such as, for example, remote computing resources (e.g., cloud based computing resources), or a mobile communication device, such as a smart phone, a tablet, a laptop or desktop computer, or another computing device remote from the device 100. The wireless interface 726 may allow the processor(s) 704 to send information to the remote computing device, and may include information such as, for example, to volume of dispensed beverage, the time of day associated with dispensed beverage, the time taken to dispense beverage, the volumetric flow rate of dispensed beverage, the type of dispensed beverage, an identifier associated with the device 100, and identification of the dispense beverage, an alert associated with the device 100 or with the dispensed beverage, or other information that may provide useful.

A control 728 may be provided as part of the device 100 and may include one or more buttons to provide input to the device 100. The one or more switches 722 described above may be part of the control 728 and may allow an operator to manually control the dispensing of beverage through pushing one or more buttons or actuating one or more switches. As described, the control 728 may additionally include a source replacement switch to indicate to the system that a beverage source has been replaced and the processor can track usage of the beverage source.

In some embodiments, a display 730 may be coupled to the device 100 and may provide controls, informational displays, usage statistics, or other information that may be helpful to a user. For example, a display 730 may show information such as the temperature of the dispensed beverage, the volume of dispensed beverage, the volume of beverage left in a keg, the date and/or time the keg was last replaced, an identification of the beverage, order information associated with customer orders that have yet to be filled, and other information. The display 730 may be any suitable display, and may include, without limitation, a series of indicator lights, an LED display, a touch screen display, a text-only display, or some other type of display that can relay visual or haptic information to a user. The display may be integrated into the device 100, and may be part of the upper portion 118, or may be mounted to the device 100, or may be a remote display. In some cases, the display may be a part of the user's point of sale system and the device 100 sends a display signal to the point of sale system to provide visual information associated with the device. The video signal may be sent to the display by a wire, which may include any suitable video signal cable, which may include, for example, DVI, HDMI, USB, or any other or future developed video transmission technology. The video signal may alternatively be sent wirelessly to a display through any suitable protocols.

The feedback 732 system may include one or more indicators that provide feedback to a user of the device 100. For instance, a visual indicator 746, which may be a light, such as an LED, can provide useful information to a user based upon a displayed color, a blinking pattern, or other visual indication. In a simplest example, the visual indicator 746 may inform a user that the device 100 is receiving power. As another example, the visual indicator 746 may indicate to a user that the beverage source needs to be replaced, such as by displaying a particular color, or flashing in a pattern, or a combination of color and pattern. As a further example, the visual indicator 746 may indicate to a user that there is a problem with the device 100, and may provide further information relating to the nature of the problem, such as a beverage temperature exceeding a threshold value, a volume of the beverage reaching a threshold value, a pressure of the beverage reaching a threshold pressure, among other types of feedback information.

Figure 8:
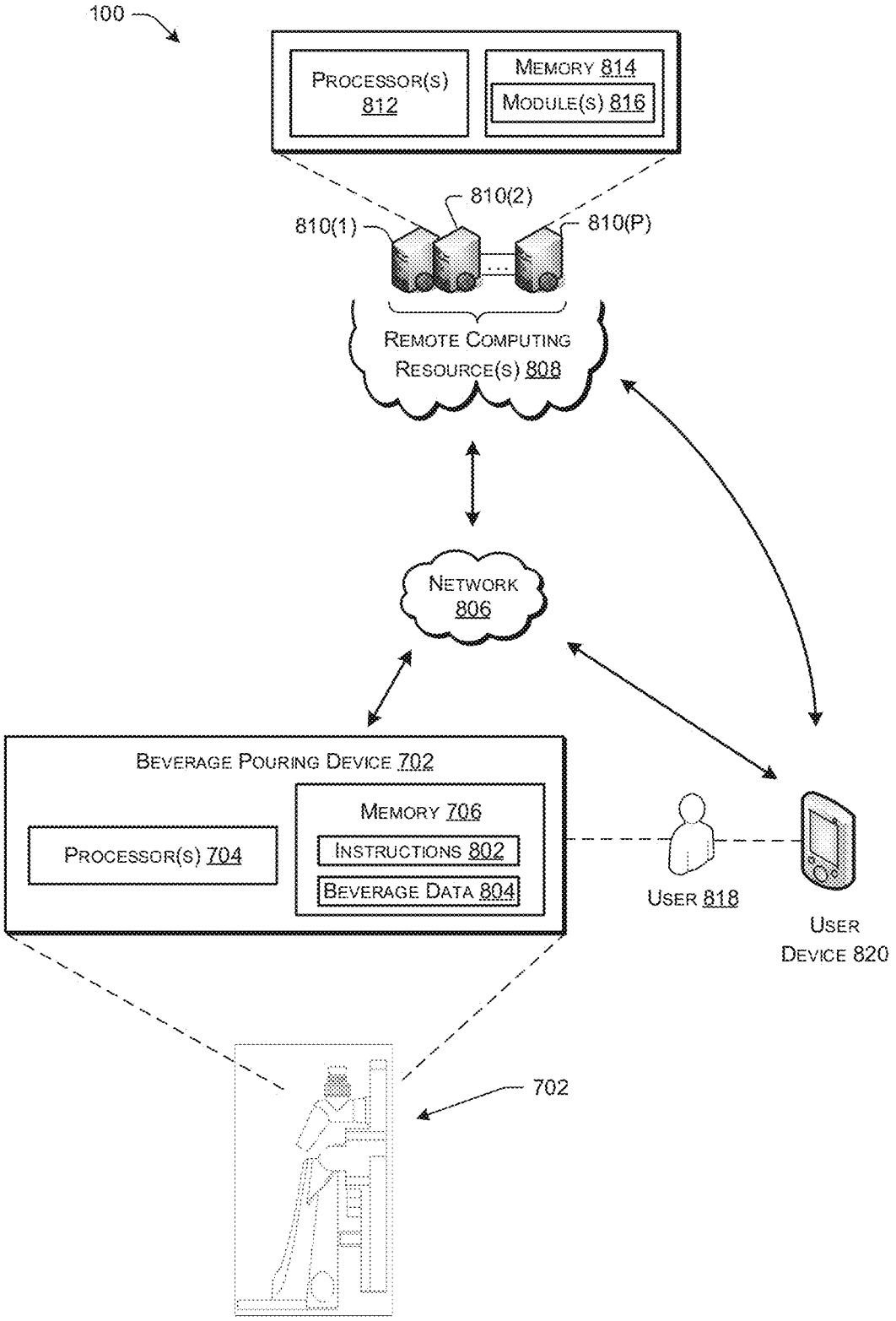
FIG. 8 illustrates a system architecture of a beverage dispenser, in accordance with some embodiments.

With reference to FIG. 8, a schematic overview is shown of the device 702, which may be substantially as described elsewhere herein. The beverage pouring device 701 may have one or more processors 704 in communication with one or more memory devices 706. The memory 706 stores instruction 802, which may be in the form of programs, modules, or some other format that, when executed, cause the processor(s) 704 to perform acts. Beverage data 804 may be generated, tracked, stored, analyzed and delivered to consumption. The beverage data 804 may include any data associated with the dispensing of the beverage and may include, without limitation, a day/time of dispensing, the type of product dispensed, the time to reach the first threshold, the time to reach the second threshold, the total time of pour, the remaining volume in the keg, the temperature of the beverage, among other types of data.

The beverage pouring device 702 may be in communication with a network 806, which may be a WAN, a LAN, the Internet, or some other network that allows data communications. In some embodiments, the communication with the network 806 is performed wirelessly. The network 806, in turn, may be in communication with remote computing resources 808. The remote computing resources 808 may include one or more servers 810(1), 810(2), 810(P). The remote computing resources 808 may include one or more processors 812 in communication with memory 814, which may store one or more modules 816 that provide instructions to the one or more processors 812. Additionally, or alternatively, the remote computing resources may be a distributed networking environment, such as, for example, cloud computing resources.

A user 818 may have access to the device 702 and may obtain information directly from the device 702, such as by viewing one or more of visual indicators, information shown on a display, or by looking at data on a user device 820 that may be in communication with the device 702. In some examples, the user 818 is remote from the device 702 and is able to view information associated with the beverage pouring device 702 through the network 806, or by receiving data from the remote computing resources 808.

In use, the device 702 may be installed onto a tap as described herein. The tap handle may be actuated and left in an actuated orientation and the dispensing of the beverage is then controlled by the device 702.

A user (e.g., bartender) may place a glass on the cradle and manually pivot the cradle from the first position to the second position about the pivot to tip the cradle and the glass relative to the spigot. As the cradle reaches the second position, it engages the latch which holds the cradle in the second position and activates a switch which opens a valve to dispense the beverage through the spigot. The flow sensor generates data associated with the volumetric flow of the beverage and when the flow reaches a first threshold, the latch disengages and the cradle and partially filled glass are allowed to pivot to the second position. A damper encourages the cradle and glass to return to the first position, by the force of gravity, in a slow and controlled manner. In some cases, the movement of the cradle from the second position to the first position may be controlled by a motor, while in other cases, pivoting is by the force of gravity and may involve a damper to slow the transition from the second position to the first position.

The valve continues to fill the glass until the flow sensor sends an indication that the total volume flow into the glass has reached a second threshold. In some cases, the threshold is relative to the volume of the glass, and the threshold may be within 5%, 10%, 15%, or 20% of the total volume of the glass.

In some cases, the first threshold is adjustable so that a first volume of product can be poured into a glass before the latch releases the cradle and the glass and cradle move to the second position before filling the rest of the glass. Similarly, the total dispensed volume may be adjustable depending on the size of the glass that is placed on the cradle. For example, the user may have a selector to indicate the size of the glass. The selector may be one or more buttons, or may be a location on a touch screen, or may be some other selector. The selector may allow a user to choose between set volumes of glasses, such as 12 oz., 16 oz, 20 oz. or some other volume. Once the cradle is moved to the second position, the device 702 may begin to dispense the beverage until the first threshold volume is met and the device 702 may then release the cradle from its second position and the cradle moves to the first position. The device 702 may continue to dispense beverage as the cradle moves to the first position, or may delay dispensing beverage for a set time while the cradle moves to the first position and then the device 702 may continue to dispense beverage until the second threshold volume is reached.

In some cases, the beverage pouring device is a stand alone device that mounts to the front of a tap wall. It may include all of the components, features, and benefits described herein and be entirely located forward of the tap wall. In other words, when installing the device, there may not be a need to access the beverage lines to install sensors, valves, and the like. However, in some embodiments, the flow valve may be installed into an existing beverage line, such as by disconnecting the beverage line from the back of the spigot and connecting the beverage line to the flow valve, and then coupling the flow valve to the back of the spigot. Of course, other locations for the flow valve, such as at an inlet or outlet end of a spigot, are contemplated to provide the features and benefits described herein.

Figure 9:
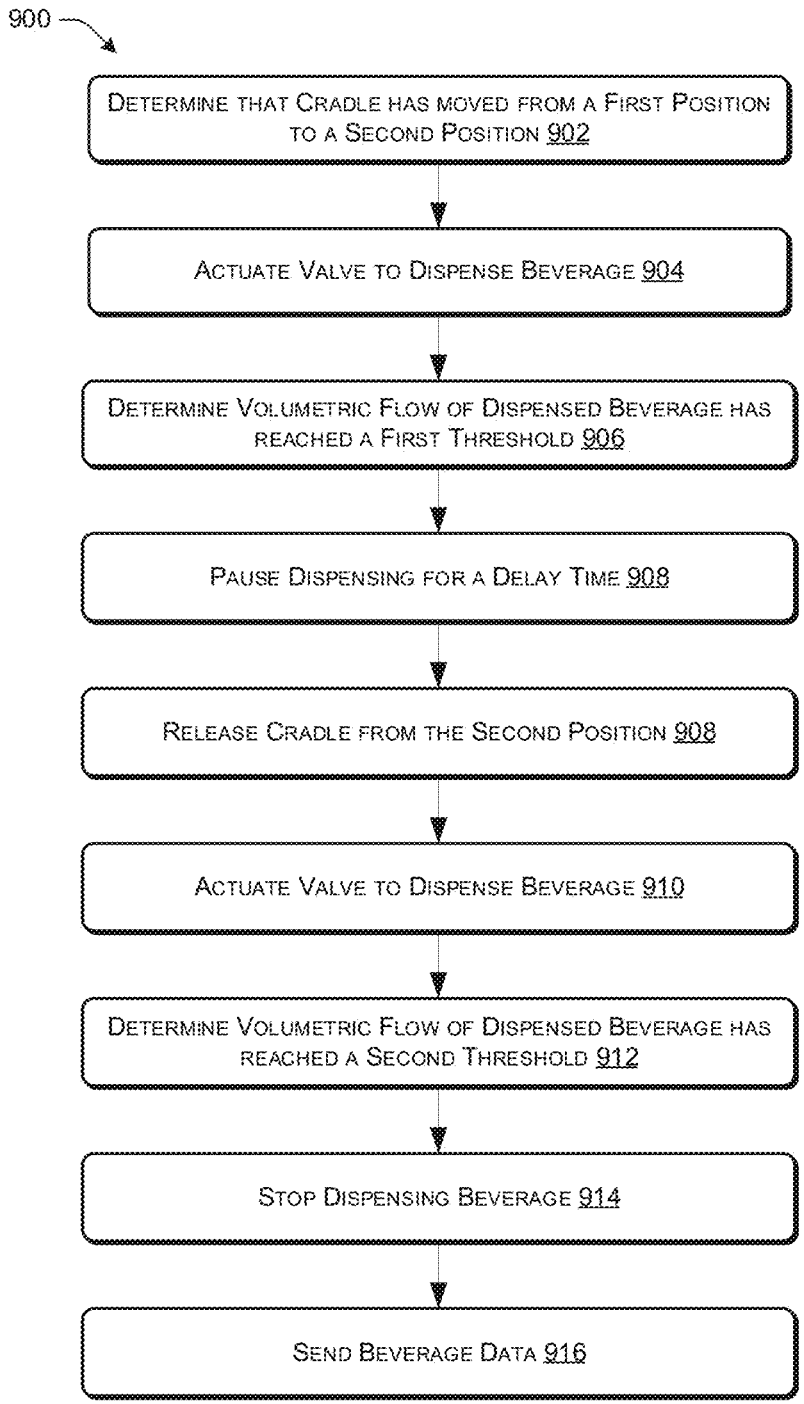
FIG. 9 illustrates a process flow diagram of a method of dispensing a beverage, in accordance with some embodiments.

FIG. 9 illustrates a sample process flow 900 from the perspective of the beverage pouring device 702. At block 902, the device 702 determines that the cradle has moved from a first position to a second position. This may be, for example, by a portion of the cradle actuating a switch. In some examples, the cradle is maintained in the second position by a latch that is actuatable by the processor.

At block 904, the device 702 actuates a valve to open the valve to dispense the beverage. In some cases, the beverage is pressurized and opening the valve allows the pressure to force the beverage through the spigot to dispense the beverage into a glass.

At block 906, the device 702 determines that the volume of the dispensed beverage reaches a first threshold. This may be performed, for example, by a flow sensor that is configured to determine the volumetric flow rate of the beverage. The processor can compare the volumetric flow to a threshold value and once the volumetric value reaches the threshold, the processor can execute further instructions.

At block 908, dispensing is paused for a delay time. The dispensing may be paused, for example, based upon an instruction from the processor to close the valve, such as by actuating a solenoid.

At block 910, the cradle may be released from its second position. In some cases, the processor, based at least in part on determining that the volumetric flow of dispensing beverage has reached the first threshold, issues an instruction to the latch to release the cradle. In some examples, the cradle is allowed to return to the first position, such as by the force of gravity. The dispensing may be paused for a time sufficient for the cradle to return to the first position, or at least approach the first position before the valve is again opened.

At block 910, the valve is actuated to continue dispensing beverage into the glass. This may be performed by an instruction from the processor to open the valve and continue dispensing beverage, and may occur after a predetermined delay time elapses.

At block 912, the device 702 determines that the volumetric flow of dispensed beverage has reached a second threshold. In some cases, the second threshold is dependent upon the volume of the glass into which the beverage is being dispensed. In some instances, the second threshold is user customizable, such as by pushing a button, or making a selection, that identifies the volume or size of the glass.

At block 914, once the volume of dispensed beverage reaches the second threshold, the device 702 stops dispensing the beverage. This may be performed by the processor issuing an instruction to cause the valve to be closed. It should be noted that wen the device 702 is controlling the flow of beverage, the tap handle may be pulled forward, which opens the tap valve, and the tap handle can be left in this position which allows the device 702 to fully control the flow of beverage.

At block 916, the device 702 optionally stores and/or sends beverage data, such as to a remote computing device. This may include any of number of statistics. Further, the device 702 may determine that the total dispensed volume since the last time the keg was changed has reached a threshold volume, and the device 702 can create a notification that the keg needs to be replaced.

The described devices, systems, and methods provide numerous benefits for a commercial establishment. For example, once a user tips the cradle, the user is then free to carry out other tasks during the time it takes the device to fill the glass. During busy time, this can free up a substantial amount of the users time to attend to other customers or projects. Further, because the dispensed volume is controlled, there is little risk of overpouring or underpouring, which promotes a positive customer experience. Many people believe that properly pouring a beer is a learned art, a device that repeatably controls foam will provide a positive customer experience. The beverage data tracking capabilities allow a business owner to track consumption of beverage, such as for inventory control and also to know when a beverage source (e.g., a keg) needs to be replaced. The beverage statistical information may be analyzed to determine trends, profitability, busy days/hours in an establishment, among other things. The beverage statistics may include information such as, but not limited to, the type of beverage, the time of each pour, the amount of each pour, the volume setting of the first threshold, the volume setting of the second threshold, the total amount of time for the pour, the remaining volume in the keg, and the price/cost of each poured beverage. The beverage statistics may be stored in the memory and downloaded by a user at a convenient time. Additionally, or alternatively, the beverage statistics may be sent to a remote computing device, such as a remote server, a computing device associated with a user (e.g., a smartphone or tablet), or some other device.

The disclosure sets forth example embodiments and, as such, is not intended to limit the scope of embodiments of the disclosure and the appended claims in any way. Embodiments have been described above with the aid of functional building blocks illustrating the implementation of specified components, functions, and relationships thereof. The boundaries of these functional building blocks have been arbitrarily defined herein for the convenience of the description. Alternate boundaries can be defined to the extent that the specified functions and relationships thereof are appropriately performed.

The foregoing description of specific embodiments will so fully reveal the general nature of embodiments of the disclosure that others can, by applying knowledge of those of ordinary skill in the art, readily modify and/or adapt for various applications such specific embodiments, without undue experimentation, without departing from the general concept of embodiments of the disclosure. Therefore, such adaptation and modifications are intended to be within the meaning and range of equivalents of the disclosed embodiments, based on the teaching and guidance presented herein. The phraseology or terminology herein is for the purpose of description and not of limitation, such that the terminology or phraseology of the specification is to be interpreted by persons of ordinary skill in the relevant art in light of the teachings and guidance presented herein.

The breadth and scope of embodiments of the disclosure should not be limited by any of the above-described example embodiments, but should be defined only in accordance with the following claims and their equivalents.

Throughout the instant specification, the term "substantially" in reference to a given parameter, property, or condition may mean and include to a degree that one of ordinary skill in the art would understand that the given parameter, property, or condition is met with a small degree of variance, such as within acceptable tolerances. By way of example, depending on the particular parameter, property, or condition that is substantially met, the parameter, property, or condition may be at least approximately 90% met, at least approximately 95% met, or even at least approximately 99% met.

Conditional language, such as, among others, "can," "could," "might," or "may," unless specifically stated otherwise, or otherwise understood within the context as used, is generally intended to convey that certain implementations could include, while other implementations do not include, certain features, elements, and/or operations. Thus, such conditional language generally is not intended to imply that features, elements, and/or operations are in any way required for one or more implementations or that one or more implementations necessarily include logic for deciding, with or without user input or prompting, whether these features, elements, and/or operations are included or are to be performed in any particular implementation.

The specification and drawings disclose examples of systems, apparatus, devices, and techniques that may allow modules of a nuclear reactor to be fabricated in a manufacturing facility and shipped to a construction site, where the modules can be assembled, thereby greatly reducing on-site fabrication complexity and cost. Further, the systems of the nuclear reactor have been simplified and further promote factory fabrication in lieu of on-site fabrication.

A person of ordinary skill in the art will recognize that any process or method disclosed herein can be modified in many ways. The process parameters and sequence of the steps described and/or illustrated herein are given by way of example only and can be varied as desired. For example, while the steps illustrated and/or described herein may be shown or discussed in a particular order, these steps do not necessarily need to be performed in the order illustrated or discussed.

The various exemplary methods described and/or illustrated herein may also omit one or more of the steps described or illustrated herein or comprise additional steps in addition to those disclosed. Further, a step of any method as disclosed herein can be combined with any one or more steps of any other method as disclosed herein.

It is, of course, not possible to describe every conceivable combination of elements and/or methods for purposes of describing the various features of the disclosure, but those of ordinary skill in the art recognize that many further combinations and permutations of the disclosed features are possible. Accordingly, various modifications may be made to the disclosure without departing from the scope or spirit thereof. Further, other embodiments of the disclosure may be apparent from consideration of the specification and annexed drawings, and practice of disclosed embodiments as presented herein. Examples put forward in the specification and annexed drawings should be considered, in all respects, as illustrative and not restrictive. Although specific terms are employed herein, they are used in a generic and descriptive sense only, and not used for purposes of limitation.

Unless otherwise noted, the terms "connected to" and "coupled to" (and their derivatives), as used in the specification, are to be construed as permitting both direct and indirect (i.e., via other elements or components) connection. In addition, the terms "a" or "an," as used in the specification, are to be construed as meaning "at least one of." Finally, for ease of use, the terms "including" and "having" (and their derivatives), as used in the specification, are interchangeable with and have the same meaning as the word "comprising."

From the foregoing, and the accompanying drawings, it will be appreciated that, although specific implementations have been described herein for purposes of illustration, various modifications may be made without deviating from the spirit and scope of the appended claims and the elements recited therein. In addition, while certain aspects are presented below in certain claim forms, the inventors contemplate the various aspects in any available claim form. For example, while only some aspects may currently be recited as being embodied in a particular configuration, other aspects may likewise be so embodied. Various modifications and changes may be made as would be obvious to a person skilled in the art having the benefit of this disclosure. It is intended to embrace all such modifications and changes and, accordingly, the above description is to be regarded in an illustrative rather than a restrictive sense.

What is claimed is:

1. A beer pouring device, comprising:

one or more processors;

memory in communication with the one or more processors, the memory storing instructions that, when executed by the one or more processors, cause the one or more processors to perform acts;

a mount configured to mount the device to a beer tap;

a cradle pivotally coupled to the mount, the cradle configured to hold a glass and to be moved between a first position and a second position;

a latch for securing the cradle in the second position;

a switch located on the mount and configured to be actuated by the cradle in the second position;

an electrically actuatable fluid valve;

a flow sensor along a fluid flow path to determine a volumetric flow of beer along the fluid flow path; and a wireless communication system configured to send beverage data to a remote computing device.

2. The beer pouring device as in claim 1, further comprising a control system comprising one or more user actuatable buttons to control the electrically actuatable fluid valve.

3. The beer pouring device as in claim 1, wherein the cradle is configured to move from the second position to the first position via gravity, and further comprising a damper in the mount to slow a movement of the cradle from the second position to the first position.

4. The beer pouring device as in claim 1, wherein the instructions cause the one or more processors to:

determine that the cradle is in the second position; and actuate the electrically actuatable fluid valve to dispense beer.

5. The beer pouring device as in claim 4, wherein the instructions cause the one or more processors to:

release the cradle from the second position;

determine a total volume of beer dispensed; and actuate, in response to determining that the total volume of beer dispensed has reached a threshold value, the electrically actuatable fluid valve to stop dispensing beer.

6. The beer pouring device as in claim 1, wherein the second position allows a glass supported by the cradle to be oriented at an angle with respect to a spigot to cause dispensed beer to contact a side of the glass.

7. The beer pouring device as in claim 1, further comprising a feedback system, the feedback system configured to alert a user when a keg of beer in fluid communication with the beer pouring device is nearly empty.

8. The beer pouring device as in claim 7, wherein the feedback system comprises a light.

9. The beer pouring device as in claim 1, wherein the beverage data comprises one or more of a time and/or date of a pour, an elapsed time associated with the pour, an identification of the beer, a total volume of beer dispensed, and the volume of beer remaining in a keg.

10. A method of dispensing a beverage from a beverage dispensing system having a cradle moveable between a first position and a second position, a fluid valve, and a flow sensor, comprising:

determining that the cradle has moved from the first position to the second position;

actuating the fluid valve to dispense the beverage;

determining, by the flow sensor, that a volumetric flow of dispensed beverage has reached a first volume threshold;

releasing the cradle from the second position and allowing the cradle to return to the first position;

determining, by the flow sensor, that the volumetric flow of dispensed beverage has reached a second volume threshold;

actuating the fluid valve to stop dispensing the beverage; and determining beverage data associated with the dispensing of the beverage and storing the beverage data;

wherein the beverage data comprises one or more of an identifier associated with the beverage, a date and/or time of day that the beverage is dispensed, a first elapsed time to reach the first volume threshold, a second elapsed time to reach the second volume threshold, a total volume dispensed, a remaining volume in a beverage storage container, a temperature of the beverage, a number of times the beverage is dispensed, and an indication when a beverage storage container in fluid communication with the beverage dispensing system is replaced.

11. The method of claim 10, further comprising sending the beverage data to a remote computing resource.

12. The method of claim 10, further comprising closing the valve, for a delay time, while the cradle at least partially moves from the second position to the first position.

13. The method of claim 12, further comprising actuating the valve, after the delay time, to continue dispensing beverage.

* * * * *